US006527567B1

(12) United States Patent
Aguirre, Jr.

(10) Patent No.: US 6,527,567 B1
(45) Date of Patent: Mar. 4, 2003

(54) LOCKING JACK COVER SYSTEM

(76) Inventor: Guadalupe Aguirre, Jr., 11414 Sagekaron, Houston, TX (US) 77089

( * ) Notice: Subject to any disclaimer, the term of this patent is extended or adjusted under 35 U.S.C. 154(b) by 0 days.

(21) Appl. No.: 10/177,318

(22) Filed: Jun. 21, 2002

(51) Int. Cl.[7] ..... H01R 13/44
(52) U.S. Cl. ..... 439/148; 439/332
(58) Field of Search ..... 439/148, 135, 439/669, 345, 332

(56) References Cited

U.S. PATENT DOCUMENTS

| | | | | |
|---|---|---|---|---|
| 1,401,217 A | | 12/1921 | Weiss | 439/750 |
| 1,536,068 A | | 5/1925 | Bohlman | 439/669 |
| 1,722,739 A | | 7/1929 | Ford | 439/669 |
| 4,886,471 A | * | 12/1989 | Fleshman, Jr. | 439/587 |
| 5,017,148 A | | 5/1991 | Buckshaw | 439/148 |
| 5,096,430 A | | 3/1992 | D'Amico | 439/148 |
| D355,892 S | * | 2/1995 | Pyzik | D13/156 |
| 5,395,264 A | * | 3/1995 | Keith | 439/502 |
| D357,667 S | | 4/1995 | Lucey et al. | |
| 5,885,280 A | * | 3/1999 | Nettekoven et al. | 606/41 |

* cited by examiner

*Primary Examiner*—Lynn Field
*Assistant Examiner*—Hae Moon Hyeon

(57) ABSTRACT

A locking jack cover system for preventing debris from entering input/output jacks. The locking jack cover system includes an instrument with an input/output jack, the input/output jack having a protrusion extending from an interior wall, a jack cover with a head portion and an insertion portion, the insertion portion being adapted for engaging the input/output jack, the jack cover being rotatable for selectively engaging the protrusion of the input/output jack.

7 Claims, 2 Drawing Sheets

LOCKING JACK COVER SYSTEM

BACKGROUND OF THE INVENTION

1. Field of the Invention

The present invention relates to electrical connector covers and more particularly pertains to a new locking jack cover system for preventing debris from entering input/output jacks.

2. Description of the Prior Art

The use of electrical connector covers is known in the prior art. More specifically, electrical connector covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,401,217; 1,536,068; 5,096,430; 1,722,739; 5,017,148; and U.S. Pat. No. Des. 357,667.

While these devices fulfill their respective, particular objectives and requirements, the aforementioned patents do not disclose a new locking jack cover system. The inventive device includes an instrument with an input/output jack, the input/output jack having a protrusion extending from an interior wall, a jack cover with a head portion and an insertion portion, the insertion portion being adapted for engaging the input/output jack, the jack cover being rotatable for selectively engaging the protrusion of the input/output jack.

In these respects, the locking jack cover system according to the present invention substantially departs from the conventional concepts and designs of the prior art, and in so doing provides an apparatus primarily developed for the purpose of preventing debris from entering input/output jacks.

SUMMARY OF THE INVENTION

In view of the foregoing disadvantages inherent in the known types of electrical connector covers now present in the prior art, the present invention provides a new locking jack cover system construction wherein the same can be utilized for preventing debris from entering input/output jacks.

The general purpose of the present invention, which will be described subsequently in greater detail, is to provide a new locking jack cover system apparatus and method which has many of the advantages of the electrical connector covers mentioned heretofore and many novel features that result in a new locking jack cover system which is not anticipated, rendered obvious, suggested, or even implied by any of the prior art electrical connector covers, either alone or in any combination thereof.

To attain this, the present invention generally comprises an instrument with an input/output jack, the input/output jack having a protrusion extending from an interior wall, a jack cover with a head portion and an insertion portion, the insertion portion being adapted for engaging the input/output jack, the jack cover being rotatable for selectively engaging the protrusion of the input/output jack.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new locking jack cover system apparatus and method which has many of the advantages of the electrical connector covers mentioned heretofore and many novel features that result in a new locking jack cover system which is not anticipated, rendered obvious, suggested, or even implied by any of the prior art electrical connector covers, either alone or in any combination thereof.

It is another object of the present invention to provide a new locking jack cover system which may be easily and efficiently manufactured and marketed.

It is a further object of the present invention to provide a new locking jack cover system which is of a durable and reliable construction.

An even further object of the present invention is to provide a new locking jack cover system which is susceptible of a low cost of manufacture with regard to both materials and labor, and which accordingly is then susceptible of low prices of sale to the consuming public, thereby making such locking jack cover system economically available to the buying public.

Still yet another object of the present invention is to provide a new locking jack cover system which provides in the apparatuses and methods of the prior art some of the advantages thereof, while simultaneously overcoming some of the disadvantages normally associated therewith.

Still another object of the present invention is to provide a new locking jack cover system for preventing debris from entering input/output jacks.

Yet another object of the present invention is to provide a new locking jack cover system which includes an instrument with an input/output jack, the input/output jack having a protrusion extending from an interior wall, a jack cover with a head portion and an insertion portion, the insertion portion being adapted for engaging the input/output jack, the jack cover being rotatable for selectively engaging the protrusion of the input/output jack.

Still yet another object of the present invention is to provide a new locking jack cover system that improves the acoustic performance of instruments by maintaining the instruments natural resonance.

Even still another object of the present invention is to provide a new locking jack cover system that extends the usable life of musical instruments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
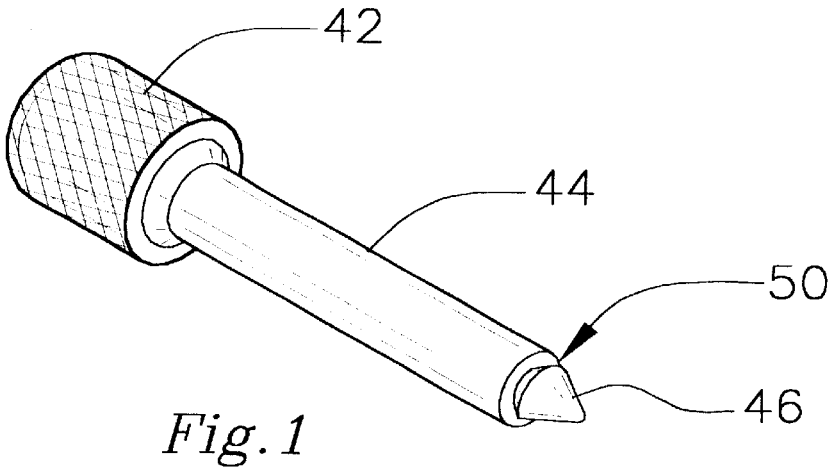
FIG. 1 is a schematic perspective view of a new locking jack cover system according to the present invention.
Figure 2:
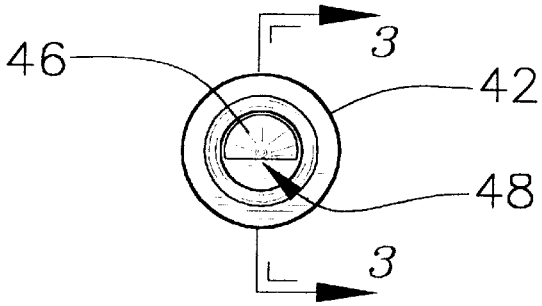
FIG. 2 is a schematic end view of the present invention.
Figure 3:
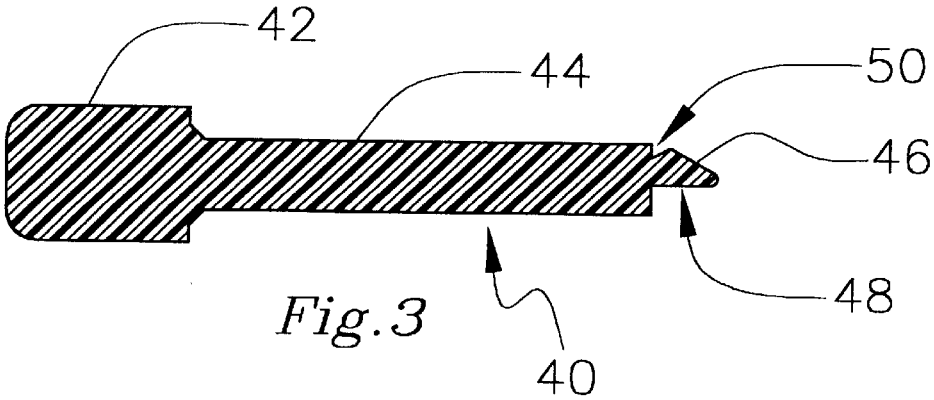
FIG. 3 is a schematic cross-sectional view of the present invention taken along line 3—3 of FIG. 2.
Figure 4:
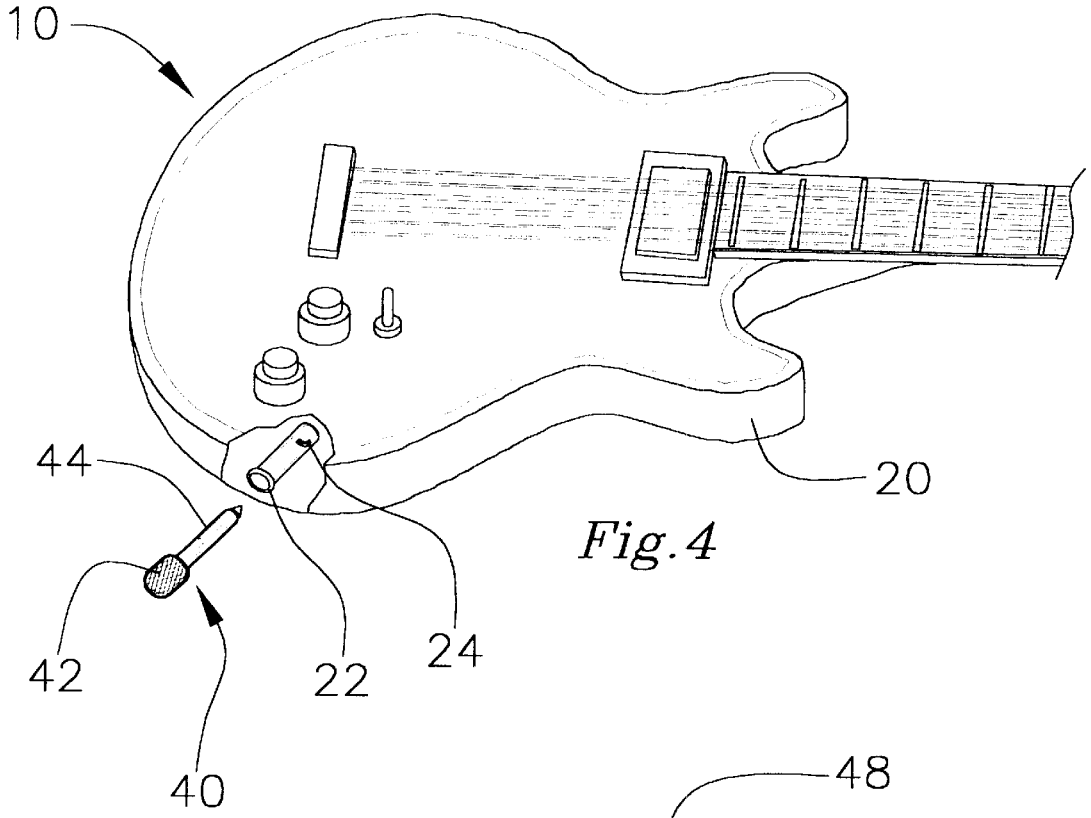
FIG. 4 is a schematic perspective view of the present invention.
Figure 5:
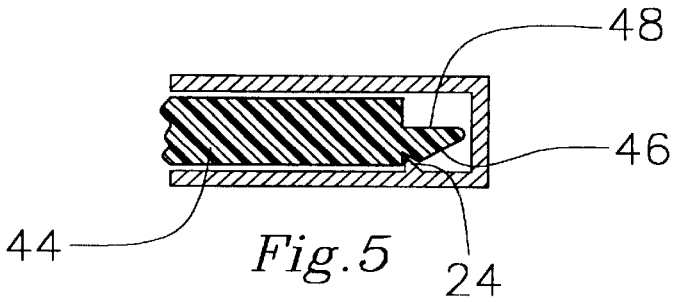
FIG. 5 is a schematic cross-sectional view showing the present invention in the locked position.
Figure 6:
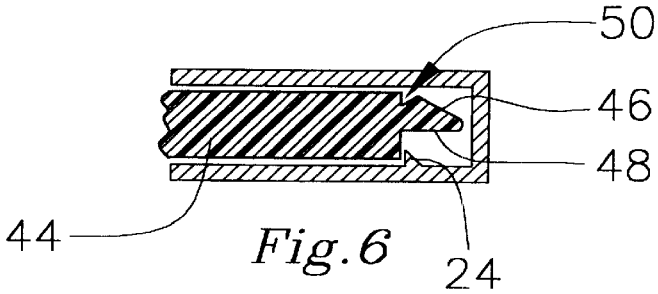
FIG. 6 is a schematic cross-sectional view showing the present invention in the unlocked position.

With reference now to the drawings, and in particular to FIGS. 1 through 6 thereof, a new locking jack cover system embodying the principles and concepts of the present invention and generally designated by the reference numeral 10 will be described.

As best illustrated in FIGS. 1 through 6, the locking jack cover system 10 generally comprises an instrument 20 and a jack cover 40.

The instrument 20 includes an input/output jack 22. The instrument 20 includes a protrusion 24 extending from an interior wall of the input/output jack 22 such that the protrusion 24 is positioned in the input/output jack 22.

The jack cover 40 includes a head portion 42 and an insertion portion 44. The insertion portion 44 is for inserting into the input/output jack 22 of the instrument 20 such that the head portion 42 covers the input/output jack 22 of the instrument. Thus the head portion 42 is designed for preventing debris from entering the input/output jack 22 while the insertion portion 44 is fully inserted into the input/output jack 22.

The insertion portion 44 includes a distal end portion 46. The distal end portion 46 includes a planar face 48 positioned such that a longitudinal axis of the insertion portion 44 is positioned within the planar face.

The distal end portion 46 includes a semi-circumferential groove 50 extending around a proximal end of an outer wall of the distal end portion 46. The semi-circumferential groove 50 is positioned in a plane orthogonal to the longitudinal axis of the insertion portion 44. The distal end portion 46 tapers towards an outermost point for facilitating insertion of the jack cover 40 into the input/output jack 22.

The jack cover 40 is rotatable such that the protrusion 24 is positionable in the groove 50 when the insertion portion 44 is fully inserted into the input/output jack 22 to define a locking position. Thus the jack cover 40 is prevented from being pulled from the input/output jack 22. The jack cover 40 further is rotatable such that the planar face 48 faces the protrusion to define an unlocked position. Thus the jack cover 40 is removable from the input/output jack 22.

The head portion 42 includes a circular cross-section taken transverse to the longitudinal axis of the insertion portion 44. The head portion 42 includes an outer perimeter wall. An outer face of the outer perimeter wall is knurled for facilitating gripping of the head portion 42.

The jack cover 40 is constructed from a material chosen from the group of materials consisting of plastic, natural rubber and neoprene.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A locking jack cover system comprising:

an object having an input/output jack, said object having a protrusion extending from an interior wall of said input/output jack such that said protrusion is positioned in said input/output jack;

a jack cover having a head portion and an insertion portion, said insertion portion being for inserting into said input/output jack of said object such that said head portion covers said input/output jack of said object;

said insertion portion including a distal end portion, said distal end portion having a planar face positioned such that a longitudinal axis of said insertion portion is positioned within said planar face;

said distal end portion having a semi-circumferential groove extending around an outer wall of said distal end portion;

said jack cover being rotatable such that said protrusion is positioned in said groove to define a locking position whereby said jack cover is prevented from being pulled from said input/output jack, said jack cover further being rotatable such that said planar face faces said protrusion to define an unlocked position whereby said jack cover is removable from said input/output jack.

2. The locking jack cover system of claim 1, further comprising:

said head portion being adapted for preventing debris from entering said input/output jack while said insertion portion is fully inserted into said input/output jack.

3. The locking jack cover system of claim 1, further comprising:

said semi-circumferential groove being positioned in a plane orthogonal to said longitudinal axis of said insertion portion.

4. The locking jack cover system of claim 1, further comprising:

said distal end portion tapering towards an outermost position for facilitating insertion of said jack cover into said input/output jack.

5. The locking jack cover system of claim 1, further comprising:

said head portion having a circular cross-section taken transverse to said longitudinal axis of said insertion portion, said head portion having an outer perimeter wall, an outer face of said outer perimeter wall being knurled for facilitating gripping of said head portion.

6. The locking jack cover system of claim 1, further comprising:

said jack cover being constructed from a material chosen from the group of materials consisting of plastic, natural rubber and neoprene.

7. A locking jack cover system comprising:

an instrument having an input/output jack, said instrument having a protrusion extending from an interior wall of said input/output jack such that said protrusion is positioned in said input/output jack;

a jack cover having a head portion and an insertion portion, said insertion portion being for inserting into said input/output jack of said instrument such that said head portion covers said input/output jack of said instrument whereby said head portion is adapted for preventing debris from entering said input/output jack while said insertion portion is fully inserted into said input/output jack;

said insertion portion including a distal end portion, said distal end portion having a planar face positioned such that a longitudinal axis of said insertion portion is positioned within said planar face;

said distal end portion having a semi-circumferential groove extending around a proximal end of an outer wall of said distal end portion, said semi-circumferential groove being positioned in a plane orthogonal to said longitudinal axis of said insertion portion;

said distal end portion tapering towards an outermost point for facilitating insertion of said jack cover into said input/output jack;

said jack cover being rotatable such that said protrusion is positionable in said groove when said insertion portion is fully inserted into said input/output jack to define a locking position whereby said jack cover is prevented from being pulled from said input/output jack, said jack cover further being rotatable such that said planar face faces said protrusion to define an unlocked position whereby said jack cover is removable from said input/output jack;

said head portion having a circular cross-section taken transverse to said longitudinal axis of said insertion portion, said head portion having an outer perimeter wall, an outer face of said outer perimeter wall being knurled for facilitating gripping of said head portion; and said jack cover being constructed from a material chosen from the group of materials consisting of plastic, natural rubber and neoprene.

* * * * *